US007810945B2

(12) United States Patent
Mize

(10) Patent No.: US 7,810,945 B2
(45) Date of Patent: Oct. 12, 2010

(54) ADJUSTABLE LIGHT CONNECTION

(76) Inventor: Randy J. Mize, 5055 Applecross Rd., Birmingham, AL (US) 35242

( * ) Notice: Subject to any disclaimer, the term of this patent is extended or adjusted under 35 U.S.C. 154(b) by 574 days.

(21) Appl. No.: 10/889,721

(22) Filed: Jul. 13, 2004

(65) Prior Publication Data

US 2006/0012980 A1 Jan. 19, 2006

(51) Int. Cl.
*F21S 8/04* (2006.01)

(52) U.S. Cl. ..... 362/198; 362/418; 439/6; 439/642

(58) Field of Classification Search ..... 362/198, 362/250, 191, 418, 419, 420, 145; 439/6, 439/642, 502
See application file for complete search history.

(56) References Cited

U.S. PATENT DOCUMENTS 1,521,130 A * 12/1924 Schweitzer ..... 362/307
1,987,848 A * 1/1935 Gregg ..... 248/124.2
2,118,785 A * 5/1938 Birdseye et al. ..... 439/6
3,568,133 A * 3/1971 Johnson ..... 439/375
3,736,417 A * 5/1973 Williams ..... 362/430
4,305,560 A * 12/1981 Ban ..... 248/160
D281,820 S 12/1985 Oba et al.
4,907,137 A * 3/1990 Schladitz et al. ..... 362/145
5,117,340 A * 5/1992 Schafer ..... 362/148
5,285,349 A * 2/1994 Zander et al. ..... 361/641
5,383,633 A 1/1995 Ellestad
5,398,176 A 3/1995 Ahuja
5,521,803 A 5/1996 Eckert et al.
5,687,774 A 11/1997 Chiang
5,717,276 A 2/1998 Hsu
5,765,938 A 6/1998 Rousso et al.
5,810,306 A 9/1998 Hung et al.
5,906,426 A 5/1999 Farrington et al.
D413,175 S 8/1999 Kaiser et al.
6,007,215 A * 12/1999 Aizen ..... 362/145
6,280,050 B1 * 8/2001 Bird et al. ..... 362/198
6,523,970 B1 * 2/2003 Scales, III ..... 362/145
6,641,057 B2 * 11/2003 Thomas et al. ..... 239/104
2002/0131268 A1 * 9/2002 Lin ..... 362/132

FOREIGN PATENT DOCUMENTS

GB 2374211 * 10/2002

* cited by examiner

*Primary Examiner*—Sharon E Payne
(74) *Attorney, Agent, or Firm*—Philip F. Fox

(57) ABSTRACT

An adjustable light connection comprising a flexible member having a first end and a second end, a contact base connected to the first end of the flexible member, a mounted socket connected to the second end of the flexible member, and an electrical connection disposed within the flexible member and having a first end connected to the contact base and a second end connected to the mounted socket. The contact base is engageable with a light socket and the mounted socket is engageable with a light bulb.

60 Claims, 2 Drawing Sheets

ADJUSTABLE LIGHT CONNECTION

BACKGROUND OF THE INVENTION

The present invention relates generally to light connections. In particular, the present invention relates to light connections that are selectively positionable and capable of retaining selected positions.

Fixed lights used in residential dwellings, such as outdoor flood lights, are typically mounted to walls or overhang portions of the dwellings in preset positions. For example, the lights may be installed into recessed mounts inserted within the walls or overhang portions of the dwellings. A drawback to this system is that the lights are secured within the mounts in a manner that effectively restricts the lights from being repositioned. Therefore, the lights may only shine in the preset directions.

Alternatively, the lights may obtain a limited range of repositioning by being installed into pivoting or swiveling mounts. Pivoting and swiveling mounts are secured to the walls or overhang portions of the dwellings, and allow the installed lights to pivot or swivel. This provides more versatile lighting compared to the recessed mounted lights. However, the pivoting and swiveling mounted lights are restricted to merely pivoting or swiveling adjustments. As such, the pivoting and swiveling mounted lights are still subject to obstructions, which may block lighting from the lights.

Typically during residential construction, builders construct portions of a structure at different times, and generally without significant cooperation. For example, light and electrical fixtures are generally installed prior to installation of the external components, such as drainage gutters. This may be problematic because the gutters may be subsequently installed such that they block lighting from the lights. Residential owners then must either reroute the gutters or install additional lights to provide complete illumination. As such, there is a need for a light connection that allows a light source to be selectively positioned to avoid obstructions, and that is capable of retaining the selected position.

BRIEF SUMMARY OF THE INVENTION

The present invention relates to an adjustable light connection that includes a flexible member having a first end and a second end, a contact base connected to the first end of the flexible member and is engageable with a light socket, a mounted socket connected to the second end of the flexible member and is capable of fixedly accepting a light bulb, and an electrical connection disposed within the flexible member, where the electrical connection has a first end connected to the contact base and a second end connected to the mounted socket.

The present invention further relates to an adjustable light connection that includes a flexible member having a first end and a second end, a contact base means connected to the first end of the flexible member and capable of relaying electrical power from a light socket, a light socket means connected to the second end of the flexible member and capable of relaying electrical power to a light bulb, and an electrical connection means disposed within the flexible member and capable of relaying electrical power from the contact base means to the light socket means.

The present invention further relates to a kit that includes a flexible member having a first end and a second end, a contact base having a first end and a second end, a mounted socket having a first end and a second end, and an electrical connection capable of being disposed within the flexible member, the electrical connection having a first end and a second end. The first end of the contact base is engageable with a light socket, and the second end of the contact base is engageable with the first end of the flexible member. The first end of the mounted socket is engageable with a light bulb, and the second end of the mounted socket is engageable with the second end of the flexible member. The first end of the electrical connection is engageable with the second end of the contact base, where the second end of the electrical connection is engageable with the second end of the mounted socket.

The present invention further relates to an adjustable light connection that includes a contact base engageable with a light socket, a mounted socket disposed distally from the contact base, where the mounted socket is capable of fixedly accepting a light bulb, and an electrical connection having a first end connected to the contact base and a second end connected to the mounted socket. The mounted socket is selectively positionable in a three dimensional placement space relative to the contact base, and is capable of substantially retaining a position while supporting a weight of about 226 grams.

While the above-identified drawings set forth an embodiment of the invention, other embodiments are also contemplated, as noted in the discussion. In all cases, this disclosure presents the invention by way of representation and not limitation. It should be understood that numerous other modifications and embodiments may be devised by those skilled in the art, which fall within the scope and spirit of the principles of the invention. The figures may not be drawn to scale. Like reference numbers have been used throughout the figures to denote like parts.

DETAILED DESCRIPTION

Figure 1:
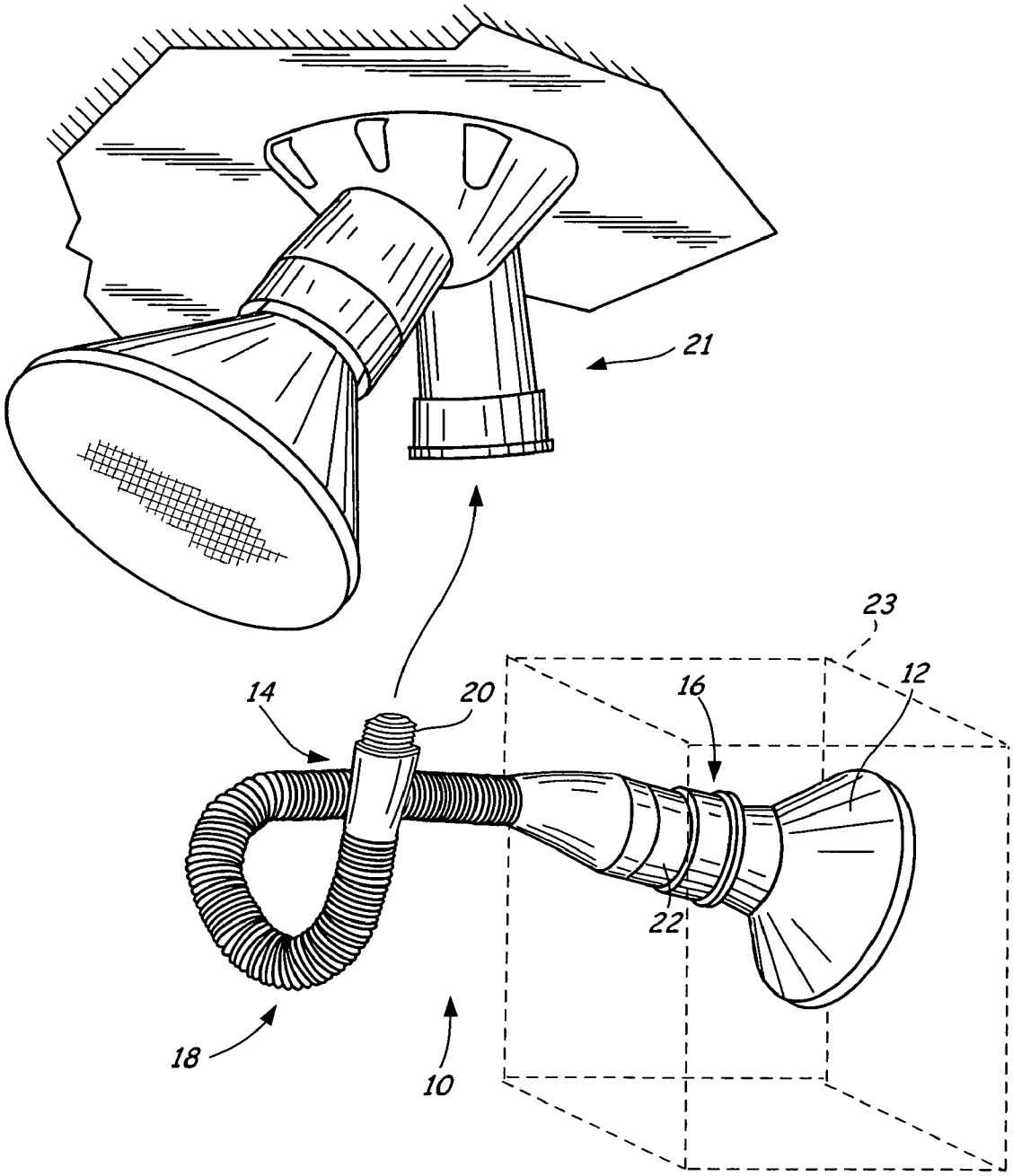
FIG. 1 is a perspective view of a selectively positionable light connection of the present invention in use.

FIG. 1 is a perspective view of an adjustable light connection 10 of the present invention in use with a light bulb 12. The adjustable light connection 10 allows the light pattern of the light bulb 12 to be selectively positioned. Furthermore, the adjustable light connection 10 is capable of retaining the selected position, and is easy to install. As depicted in FIG. 1, the adjustable light connection 10 has a proximal end 14 and a distal end 16. A flexible tube 18 is located between the proximal end 14 and the distal end 16.

The proximal end 14 of the adjustable light connection 10 includes a contact base 20 that is engageable in electrical communication with an existing light socket 21. The contact base 20 may, for example, be provided with male screw threads to provide a screw fit engagement with a standard, female screw-fit light socket. Nonetheless, the contact base 20 may be provided with any configuration, such as a plug configuration, that is capable of engaging an existing light socket 21 of any configuration. This allows electricity to be relayed from the existing light socket 21 without reconfiguration, to the adjustable light connection 10 without using any external power cords.

Moreover, by relying on the existing light sockets 21 for power, rewiring of electrical circuits and reconfiguration of existing light sockets 21 is not required for installation. The contact base 20 is simply engaged in (e.g., inserted, plugged into, or screwed into) a correspondingly-sized light socket.

This reduces time, effort, and skill required to install the adjustable light connection 10. Additionally, the adjustable light connection 10 may be readily unscrewed or unplugged from the existing light socket 21, and easily transferred to another light socket when the need arises. This further increases the versatility of the present invention.

The distal end 16 of the adjustable light connection 10 includes a mounted socket 22, which is capable of retaining the light bulb 12. The mounted socket 22 relays power provided by the contact base 20 to the light bulb 12 for illuminating the light bulb 12. As shown, the light bulb 12 may be a flood light, which is typically used as a residential outdoor light. However, the mounted socket 22 may also retain a variety of other conventional light bulbs, as well, by assuring the mounted socket 22 is configured to accept any particular light bulb that is used.

The flexible tube 18 is a flexible member that is connected to the contact base 20 proximate the proximal end 14 and to the mounted socket 22 proximate the distal end 16. The flexible tube 18 allows the mounted socket 22 and the light bulb 12 to be selectively positioned at any point within a three dimensional placement space 23 and in a variety of directions and orientations relative to the existing light socket 21 in which the contact base 20 is engaged. This allows the light bulb 12 to shine in any direction as individual needs may require from a variety of different points within the three dimensional placement space 23. Moreover, because of the extended nature of the flexible tube 18, the light bulb 12 may be selectively positioned at any point within the three dimensional placement space 23 to avoid obstructions, which would otherwise block the light from a conventionally mounted light bulb.

As depicted in FIG. 1, the three dimensional placement space 23 represents the three-dimensional coordinates that the light bulb 12 may be selectively positioned at. The three dimensional placement space 23 is not intended to represent the maximum ranges that the light bulb 12 may be selectively positioned at.

The flexible tube 18 may be selectively positioned to a desired configuration by bending the flexible tube 18 via digital manipulation at one or more points along a longitudinal length A of the flexible tube 18. The longitudinal length A of the flexible tube 18 is a length normal to a cross-section of the flexible tube 18 when the flexible tube 18 is in a straight configuration without any bends. For example, the flexible tube 18 may be selectively bent in an S-shape configuration so the light bulb 12 is oriented in the same direction as the existing light socket 21, but is laterally, or laterally and longitudinally, offset from a point directly in front of the existing light socket 21 to any desired point within the three dimensional placement space 23. This allows the light bulb 12 to shine around an obstruction that may be located in front of the existing light socket 21.

In addition to being adjustable and selectively positionable, the flexible tube 18 is also capable of substantially retaining any selected position, even while supporting a weighted object, such as the light bulb 12. The terms "substantially retaining a position", "substantially retaining any selected position", and the like, herein refer to the capability of the flexible tube 18, when the flexible tube 18 has a longitudinal length A of about 16.0 inches (about 40.6 centimeters (cm)), to support a weighted object (e.g., the light bulb 12) at the mounted socket 22 such that the weighted object drops less than about 1.0 inch (about 2.5 cm) over a period of about 24 hours due to gravity. This allows continuing use of the adjustable light connection 10 without repeated positional readjustments. Accordingly, the adjustable light connection 10 provides a convenient and easy installation into a standard light socket for redirecting and positionally retaining the light bulb 12 within the three dimensional placement space 23.

As noted above, the longitudinal length A of the flexible tube 18 may be about 16.0 inches. Furthermore, the longitudinal length A of the flexible tube 18 may be any desired length greater than about 1.0 inch (about 2.5 cm), although the longitudinal length A will typically be less than about 20 inches (about 50.8 cm).

Figure 2:
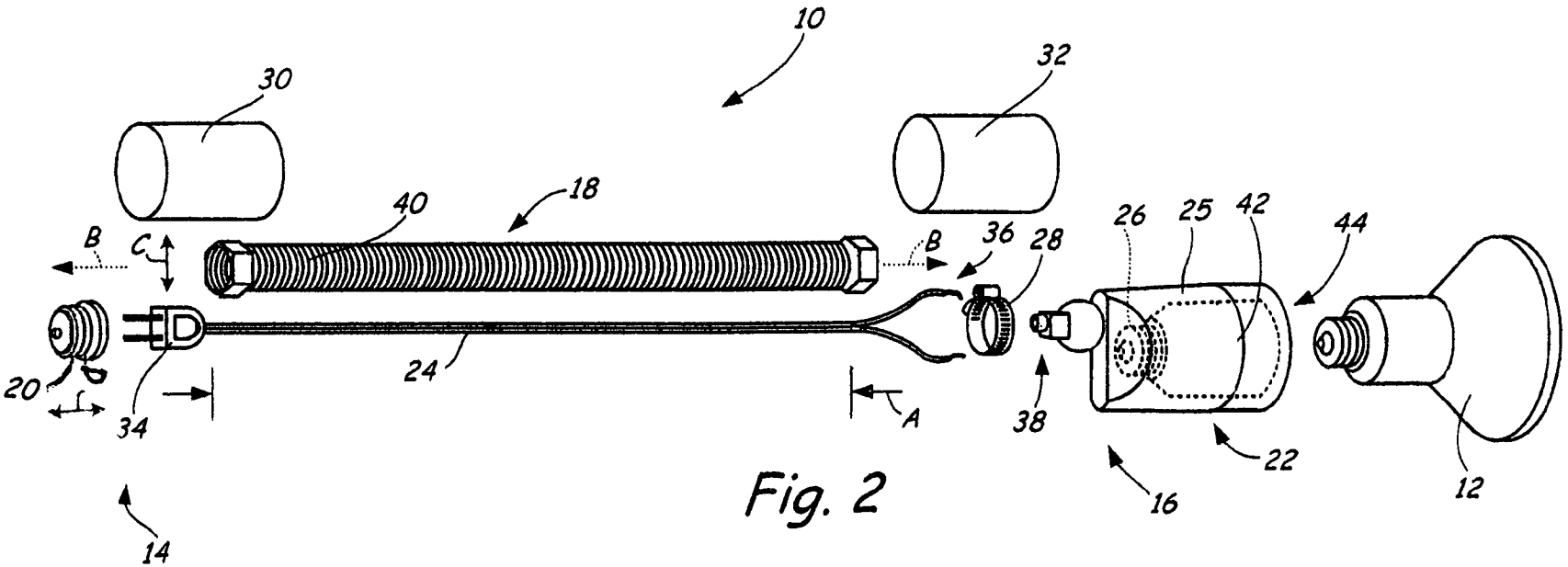
FIG. 2 is an exploded perspective view of a selectively positionable light connection of the present invention.

FIG. 2 is an exploded perspective view of the adjustable light connection 10 of the present invention. As shown, the adjustable light connection 10 also includes an electrical connection 24, and may also include a protective ring 28, a sleeve 30, and a sleeve 32. The electrical connection 24, which may be any conventional electrical conductor, such as an insulated electrical conductor, will typically extend within and through the flexible tube 18, but may optionally run outside the flexible tube 18. The electrical connection 24 is more flexible than the flexible tube 18 and consequentially any selective positioning of the flexible tube 18 is replicated by the electrical connection 24.

The electrical connection 24 is electrically connected to the contact base 20 at the proximal end 14 and to the mounted socket 22 at the distal end 16. This allows the electrical connection 24 to relay power from the contact base 20 to the distal end 16. As shown in FIG. 2, the electrical connection 24 may, for example, be a conventional extension cord having a plug head 34 that plugs directly into the contact base 20 at the proximal end 14. The portion of the electrical connection 24 at the distal end 16 may be electrically connected with the mounted socket 22 in any conventional fashion. For example, the electrical connection 24 at the distal end 16 may be spliced into a pair of conductors 36 that are electrically connected to the mounted socket 22 in conventional fashion.

When the electrical connection 24 includes the plug head 34, the contact base 20 is preferably a socket-to-outlet adapter, which receives power from a light socket interface (e.g., a threaded screw contact) and outputs power as an electrical outlet interface (e.g., two-prong outlet). An example of a suitable socket-to-outlet adapter includes the trade designated "660 W Lamp Socket To Outlet Adapter", model 835-125, which is commercially available from Leviton Manufacturing Company, Inc. of Little Neck, N.Y. The Leviton model 835-125 socket-to-outlet adapter is rated up to 660 Watts and up to 125 Volts.

Suitable dimensions for the contact base 20 include dimensions compatible for use with conventional light sockets, such as screw bases designated as mogul (1-19/32 inch diameter), admedium (1-5/32 inch diameter), medium (i.e, Edison screws with 1-1/16 inch diameter and 7 threads per inch), and intermediate (5/8 inch diameter). The socket base 20 may also connect with a socket adapter for use with larger light sockets. For example, a socket base 20 exhibiting a medium screw base may be screwed into an adapter for a light socket exhibiting a mogul screw base. This increases the versatility of the adjustable light connection 10 of the present invention. The contact base 20 has length D. As depicted in FIG. 2, the length D of the contact base 20 is permissibly comparable to diameter C of the flexible tube 18. Additionally, as depicted in FIG. 2, the length D of the contact base 20 is permisibly substantially shorted than length A of the flexible member.

When engaged in the existing light socket 21 (not shown), the contact base 20 also supports the adjustable light connection 10 and helps retain the light bulb 12 at a selected position. The contact base 20 may be secured to the flexible tube 18 at the proximal end 14 such that the flexible tube 18 does not pivot or swivel freely, relative to the contact base 20. As shown, the contact base 20 may be secured to the flexible tube 18 with the sleeve 30. The sleeve 30 extends around the contact base 20 and the flexible tube 18 at the proximal end 14 to prevent the flexible tube 18 from rotating about a longitudinal axis B of the flexible tube 18 relative to the contact base 20. The sleeve 30 also protects internal components of the adjustable light connection 10 at the proximal end 14, such as the socket base 20 and the plug head 34, from external conditions.

The sleeve 30 may be derived from a variety of articles capable of retaining the contact base 20 to the flexible tube 18. Examples of suitable articles for the sleeve 30 include polymer sleeves (e.g., elastomers, thermoplastics, and cross-linkable polymers), metal sleeves, adhesive materials (e.g., electrical tape, duct tape, and aluminum tape), and combinations thereof. An example of a particularly suitable article for the sleeve 30 includes an inner adhesive material layer in combination with an outer elastomer layer. Alternatively, in lieu of the sleeve 30, the contact base 20 may be directly secured to the flexible tube 18 by conventional techniques, such as welding, gluing, riveting, and combinations thereof.

The flexible tube 18 may be derived from a variety of materials that provide both flexibility and the ability to substantially retain a selected position. This may be accomplished with materials that are resistant to being bent or adjusted, while nevertheless exhibiting adequate levels of elasticity. This combination allows the flexible tube 18 to bend under an applied force without breaking or cracking. For example, as depicted in FIG. 1, the flexible tube 18 may be a stainless-steel gas line. A stainless-steel gas line is a flexible article that is weather resistant and is capable of substantially retaining a selected position, even while supporting a relatively heavy weight, such as a flood light. Accordingly, one embodiment of the flexible tube 18 of the present invention is capable of substantially retaining a selected position while supporting a weight of about 0.25 pounds (about 113 grams), more preferably about 0.5 pounds (about 226 grams), at the distal end 16, where longitudinal length A of the flexible tube 18 is about 16 inches (about 40.6 cm).

Preferably, the flexible tube 18 exhibits dimensions that allow the adjustable light connection 10 to extend around any obstruction while at least substantially retaining the light bulb 12 at a selected point within the three dimensional placement space 23. As depicted in FIG. 1, one embodiment of the flexible tube 18 may exhibit a cross-sectional external diameter C ranging from about 0.5 inches (about 1.3 cm) to about 3.0 inches (about 7.6 cm), a thickness of a wall 40 ranging from about 0.1 inches (about 0.2 cm) to about 1.0 inch (about 2.5 cm), and the longitudinal length A ranging from about 1.0 inch (about 2.5 cm) to about 20 inches (about 50.8 cm). These dimensions will typically allow the flexible tube 18 to substantially retain an adjusted position while supporting the light bulb 12 as a flood light.

Additionally, the flexible tube 18 may be selectively extendable. For example, the flexible tube 18 may include one or more telescoping portion(s)(not shown) that allow the longitudinal length A of the flexible tube 18 to be selectively adjusted. The telescoping portion(s) may, for example, include overlapping layers that collapse for reducing the longitudinal length A and extend for enlarging the longitudinal length A. Thus, the length A of the flexible tube 18 is selectively and reversibly changeable. A portion of the electrical connection 24 may be wound up within the flexible tube 18 in a conventional manner to accommodate for longitudinal length A adjustments.

The mounted socket 22 may be fixedly secured to the flexible tube 18 at the distal end 16 so the mounted socket 22 does not pivot or swivel freely relative to the flexible tube 18. As shown, the mounted socket 22 may be secured to the flexible tube 18 using the sleeve 32. Examples of suitable materials for the sleeve 32 are the same as those described above for the sleeve 30. The sleeve 32 extends around the mounted socket 22 and the flexible tube 18 at the distal end 16 to securely retain the mounted socket 22 to the flexible tube 18.

The mounted socket 22 additionally includes a wire connection 38, which may be coupled with the pair of conductors 36 of the electrical connection 24. This allows the electrical connection 24 to relay electrical power to the mounted socket 22. To ensure the conductors 36 and the wire connection 38 remain securely coupled, a protective ring 28 may be inserted around the conductors 36 and the wire connection 38 at the coupling location. As such, the protective ring 28 is disposed between the flexible tube 18 and the mounted socket 22, and is encased by the distal end sleeve 32. A suitable example of the protective ring 28 includes a conventional radiator hose clamp, which includes a wide-band ring and a screw-based drive that allows selective tightening of the wide-band ring.

The mounted socket 22 further includes an outer casing 25 and a light socket 26 disposed within the outer casing 25. The outer casing 25 provides environmental protection to the light socket 26. The walls 42 of the outer casing 25 define an opening 44. The light bulb 12 may be inserted through the opening 44 during engagement of the light bulb 12 in the light socket 26. Examples of suitable materials for the outer casing 25 include weather-resistant, substantially-rigid plastics, metals, and combinations thereof The light socket 26 is the portion of the mounted socket 22 that retains the light bulb 12, and is preferably screw threaded to provide a female screw fit with the male screw threads of the light bulb 12. The light socket 26 is electrically connected to the wire connection 38 to relay electrical power from the electrical connection 24 to the light bulb 12.

Examples of suitable dimensions for the light socket 26 of the mounted socket 22 include dimensions of conventional light sockets, such as light sockets compatible with screw-threaded bases designated as mogul, admedium, medium, and intermediate, as discussed above in relation to the socket base 20. Preferably, the mounted socket 22 exhibits similar dimensions to the dimensions of the contact base 20. In effect, this allows the light bulb 12 that engages with the mounted socket 22 to fit in an existing light socket that the contact base 20 engages with. This reduces the potential for inadvertently using the adjustable light connection 10 with an existing light socket that is not designed to be used with the light bulb 12.

The adjustable light connection 10 may also include weather-resistant seals to provide additional protection against environmental conditions, such as rain and humidity. For example, sealant rings (e.g., rubber O-rings) may be inserted around the contact base 20 and in the light socket 26. When the contact base 20 is engaged with the existing light socket 21 and when the light bulb 12 is engaged with the light socket 26, the sealant rings provide additional support and protection against environmental conditions to these regions.

In use, a user digitally engages the light bulb 12 with the mounted socket 22 of the adjustable light connection 10. The user may then digitally engage the contact base 20 with an existing light socket (e.g., the light socket 21). The existing light socket provides a secure support base for the adjustable light connection 10. The order of engaging the adjustable light connection 10 with the light bulb 12 and the existing light socket is not important for use of the present invention. When the contact base 20 is engaged with the existing light socket, electrical power is relayed from the existing light socket to the light bulb 12, through the contact base 20, the electrical connection 24, and the mounted socket 22, respectively. The adjustable light connection 10 may be selectively repositioned as desired by bending the flexible tube 18 at one or more points along the longitudinal length A of the flexible tube 18. When adjusted, the adjustable light connection 10 substantially retains the adjusted position. This allows the light bulb 12 to emit light in the selected direction despite the orientation of the existing light socket and obstructions that would otherwise block the view of the light bulb 12. As such, the adjustable light connection 10 allows a user to direct the light bulb 12 in any desired direction to provide proper illumination.

The adjustable light connection 10 of the present invention may also be provided and assembled as a kit. The kit may include the flexible tube 18, the contact base 20, the mounted socket 22, and the electrical connection 24 as separate components, which may be connected by a user to form the adjustable light connection 10 of the present invention. As best depicted in FIG. 2, the electrical connection 24 may be inserted through the flexible tube 18. Preferably, when the electrical connection 18 is disposed within the flexible tube 18, the plug head 34 of the electrical connection 24 extends from the flexible tube 18 at the proximal end 14, and the pair of conductors 36 extend from the flexible tube 18 at the distal end 16. The contact base 20 is capable of engaging the flexible tube 18 and the electrical connection 24 (i.e., the plug head 34) at the proximal end 14. Similarly, the mounted socket 22 is capable of engaging the flexible tube 18 and the electrical connection 24 (i.e., the pair of conductors 36) at the distal end 16.

Additionally, the kit may further include the sleeves 30, 32 for connecting the contact base 20 and the mounted socket 22, respectively, to the flexible tube 18. For example, the kit may include a roll of adhesive tape that is applied by a user to the proximal end 14 and the distal end 16 to connect the contact base 20 and the mounted socket 22 to the flexible tube 18.

The kit may further include a variety of different contact bases 20, where each contact base 20 exhibits a different screw-base dimension (e.g., mogul, admedium, medium, and intermediate). This allows a user to interchange contact bases 20 to fit existing light sockets of different sizes. For example, a user may connect a contact base 20 that exhibits a medium screw base to the flexible tube 18. This allows the adjustable light connection 10 to be used with an existing light socket for medium screw-based light bulbs. If the user then desires to connect the adjustable light connection 10 to an existing light socket for mogul based light bulbs, the user may remove the currently connected contact base 20, and connect a contact base 20 that exhibits a mogul screw-base to the flexible tube 18. This further realizes the versaility of the adjustable light connection 10 of the present invention.

Similarly, the kit may further include a variety of different mounted sockets 22, where each mounted socket 22 is capable of engaging with a light bulb 12 that exhibits a different screw-base dimension (e.g., mogul, admedium, medium, and intermediate). This allows a user to interchange mounted sockets 22 to fit different size light bulbs 12.

The kit may further include a variety of flexible tubes 18, which exhibit different longtiduinal lengths, different cross-sectional diameters, and/or different wall thicknesses. This increases the range of selectively adjustable positions the adjustable light connection 10 is capable of obtaining.

Finally, the kit may further include the light bulb 12, which the user may engage with the mounted socket 22. However, the user may also use an existing light bulb 12. For example, a user may remove the light bulb 12 from an existing light socket, insert the contact base 20 of the adjustable light connection 10 into the existing light socket, and then insert the light bulb 12 into the mounted socket 22 for use. As such, the adjustable light connection 10 may be used with any existing light socket and corresponding light bulb 12.

Although the present invention has been described with reference to preferred embodiments, workers skilled in the art will recognize that changes may be made in form and detail without departing from the spirit and scope of the invention.

The invention claimed is:

1. An adjustable light connection comprising: a flexible member having a first end and a second end; a contact base connected to the first end of the flexible member, the contact base removably engageable with a light socket; a mounted socket connected to the second end of the flexible member, the mounted socket capable of fixedly accepting a light bulb; and an electrical connection having a first end connected to the contact base and a second end corrected to the mounted socket wherein said contact base comprises screw threads and is interchangeable with bases having dimensions selected from a group consisting of mogul, admedium, medium and intermediate.

2. The adjustable light connection of claim 1, wherein the contact base is further capable of relaying power from the light socket to the electrical connection.

3. The adjustable light connection of claim 1, wherein the flexible member comprises a flexible tube.

4. The adjustable light connection of claim 1, wherein the flexible member is capable of substantially retaining a position while supporting a weight of about 226 grams at the distal end.

5. The adjustable light connection of claim 1, wherein the mounted socket is engageable with a screw base exhibiting dimensions selected from a group consisting of mogul, admedium, medium, and intermediate.

6. The adjustable light connection of claim 1, wherein the mounted socket comprises an outer casing and a light socket disposed within the outer casing, the light socket capable of fixedly engaging with the light bulb.

7. The adjustable light connection of claim 1, wherein the electrical connection comprises an electrical extension cord.

8. The adjustable light connection of claim 7, wherein the electrical connection has a first end comprising a two-prong plug head that is engageable with the contact base.

9. The adjustable light connection of claim 1 wherein the light bulb and the contact base are each interchangeably mountable in the light socket.

10. The adjustable light connection of claim 1 wherein the electrical connection is disposed within the flexible member.

11. The adjustable light connection of claim 1 wherein the contact base is rated up to 660 Watts and up to 125 Volts.

12. The adjustable light connection of claim 1 wherein the contact base is a socket-to-outlet adapter.

13. The adjustable light connection of claim 1 wherein the contact base has a length D that is comparable to a diameter C of the flexible member.

14. The adjustable light connection of claim 1 wherein the contact base has a length D substantially shorter than a length A of the flexible member.

15. The adjustable light connection of claim 1 wherein the contact base is operably connectable to only a single mounted socket.

16. The adjustable light connection of claim 1 wherein the flexible member has a length A that is selectively and reversibly changeable.

17. An adjustable light connection comprising: a flexible member having a first end and a second end; a removable contact base means connected to the first end of the flexible member; a light socket means connected to the second end of the flexible member and capable of relaying electrical power to a light bulb when the light bulb is engaged with the light socket means; and an electrical connection means, the contact base means capable of relaying electrical power from a light socket to the electrical connection means and the electrical connection means capable of relaying electrical power from the contact base means to the light socket means wherein said contact base means is removably engageable with the light socket means and comprises screw threads and is interchangeable with bases having dimensions selected from a group consisting of mogul, admedium, medium and intermediate.

18. The adjustable light connection of claim 17, wherein the flexible member comprises a flexible tube.

19. The adjustable light connection of claim 17, wherein the electrical connection means comprises an electrical extension cord.

20. The adjustable light connection of claim 17 wherein the light bulb and the contact base means are each interchangeably mountable in the light socket.

21. The adjustable light connection of claim 17 wherein the electrical connection is disposed within the flexible member.

22. The adjustable light connection of claim 17 wherein the contact base means is rated up to 660 Watts and up to 125 Volts.

23. The adjustable light connection of claim 17 wherein the contact base means is a socket-to-outlet adapter.

24. The adjustable light connection of claim 17 wherein, the contact base means has a length D that is comparable to a diameter C of the flexible member.

25. The adjustable light connection of claim 17 wherein the contact base means has a length D substantially shorter than a length A of the flexible member.

26. The adjustable light connection of claim 17 wherein the contact base means is operably connectable to only a single one of the light socket means.

27. The adjustable light connection of claim 17 wherein the flexible member has a length A that is selectively and reversibly changeable.

28. A kit comprising: a flexible member having a first end and a second end; a contact base having a first end and a second end, wherein the first end of the contact base is removably engageable with a light socket, and the second end of the contact base is capable of engaging with the first end of the flexible member; a mounted socket having a first end and a second end, wherein the first end of the mounted socket is engageable with a light bulb, and the second end of the mounted socket is engageable with the second end of the flexible member; and an electrical connection capable of being disposed within the flexible member, the electrical connection having a first end and a second end, wherein the first end of the electrical connection is engageable with the second end of the contact base, and wherein the second end of the electrical connection is engageable with the second end of the mounted socket wherein said contact base comprises screw threads and is interchangeable with bases having dimensions selected from a group consisting of mogul, admedium, medium and intermediate.

29. The kit of claim 28 further comprising:

a first sleeve engageable with the contact base and the flexible member; and a second sleeve engageable with the mounted socket and the flexible member.

30. The kit of claim 28, wherein the electrical connection comprises an electrical extension cord.

31. The kit of claim 28, wherein the flexible member comprises a flexible tube.

32. The kit of claim 28 wherein at least two of the flexible member, the contact base, the mounted socket, and the electrical connection are provided as separate components of the kit.

33. The kit of claim 28 wherein the light bulb and the contact base are each interchangeably mountable in the light socket.

34. The kit of claim 28 wherein the contact base is a first contact basis, the kit further comprising a second contact base wherein the first contact base exhibits a dimension selected from the group consisting of mogul, admedium, medium, and intermediate and the second contact base exhibits a dimension selected from the group consisting of mogul, admedium, medium, and intermediate, with the dimension exhibited by the first contact base being different from the dimension exhibited by the second contact base.

35. The kit of claim 28 wherein the contact base is rated up to 660 Watts and up to 125 Volts.

36. The kit of claim 28 wherein the flexible member has a length A that is selectively and reversibly changeable.

37. The kit of claim 28 wherein the contact base is a socket-to-outlet adapter.

38. The kit of claim 28 wherein the contact base has a length D that is comparable to a diameter C of the flexible member.

39. The kit of claim 28 wherein the contact base has a length D substantially shorter than a length A of the flexible member.

40. The kit of claim 28 wherein the contact base is operably connectable to only a single mounted socket.

41. An adjustable light connection comprising: a contact base removably engageable with a light socket; a mounted socket disposed distally from the contact base, wherein the mounted socket is capable of fixedly accepting a light bulb, whereto the mortared socket is selectively positionable in a three dimensional placement space relative to the contact base, and wherein the mounted socket is capable of substantially retaining a position while supporting a weight of about 226 grams; and an electrical connection having a first end connected to the contact base and a second end connected to the mounted socket wherein said contact base comprises screw threads and is interchangeable with bases having dimensions selected from a group consisting of mogul, admedium, medium and intermediate.

42. The adjustable light connection of claim 41 further comprising a flexible member having a first end and a second end, wherein the contact base is connected to the first end of the flexible member, and wherein the mounted socket is connected to the second end of the flexible member.

43. The adjustable light connection of claim 42, wherein the electrical connection is disposed within the flexible member.

44. The adjustable light connection of claim 41, wherein the contact base comprises screw threads engageable with the light socket and exhibits dimensions selected from a group consisting of mogul, admedium, medium, and intermediate.

45. The adjustable light connection of claim 41 wherein the contact base is rated up to 660 Watts and up to 125 Volts.

46. The adjustable light connection of claim 41 wherein the contact base is a socket-to-outlet adapter.

47. The adjustable light connection of claim 41 wherein the contact base has a length D that is comparable to a diameter C of the flexible member.

48. The adjustable light connection of claim 41 wherein the contact base has a length D substantially shorter than a length A of the flexible member.

49. The adjustable light connection of claim 41 wherein the contact base is operably connectable to only a single mounted socket.

50. The adjustable light connection of claim 42 wherein the flexible member has a length A that is selectively and reversibly changeable.

51. An adjustable light connection comprising: a flexible member having a first end, a second end, and a length A that is selectively and reversibly changeable; a contact base connected to the first end of the flexible member, the contact base removably engageable with a light socket; a mounted socket connected to the second end of the flexible member, the mounted socket capable of fixedly accepting a light bulb; and an electrical connection disposed within the flexible member, the electrical connection having a first end connected to the contact base and a second end connected to the mounted socket wherein said contact base comprises screw threads and is interchangeable with bases having dimensions selected from a group consisting of mogul, admedium, medium and intermediate.

52. A kit comprising: a flexible member having a first end, a second end, and a length A that is selectively and reversibly changeable; a contact base having a first end and a second end, wherein the first end of the contact base is removably engageable with a light socket, and the second end of the contact base is capable of engaging with the first end of the flexible member; a mounted socket having a first end and a second end, wherein the first end of the mounted socket is engageable with a light bulb, and the second end of the mounted socket is engageable with the second end of the flexible member; and an electrical connection capable of being disposed within the flexible member, the electrical connection having a first end and a second end, wherein the first end of the electrical connection is engageable with the second end of the contact base, and wherein the second end of the electrical connection is engageable with the second end of the mounted socket wherein said contact base comprises screw threads and is interchangeable with bases having dimensions selected from a group consisting of mogul, admedium, medium and intermediate.

53. An adjustable light connection comprising: a contact base removably engageable with a light socket; a mounted socket disposed distally from the contact base, wherein the mounted socket is capable of fixedly accepting a light bulb, wherein the mounted socket is selectively positionable in a three dimensional placement space relative to the contact base, and wherein the mounted socket is capable of substantially retaining a position while supporting a weight of about 226 grams; an electrical connection having a first end connected to the contact base and a second end connected to the mounted socket; and a flexible member having a first end, a second end, a length A that is selectively and reversibly changeable, wherein the contact base is connected to the first end of the flexible member, and wherein the mounted socket is connected to the second end of the flexible member wherein said contact base comprises screw threads and is interchangeable with bases having dimensions selected from a group consisting of mogul, admedium, medium and intermediate.

54. An adjustable light connection comprising: a flexible member having a first end and a second end; a contact base having a first end and a second end, wherein the first end of the contact base is removably engageable with a light socket, and the second end of the contact base is connected to the first end of the flexible member; a mounted socket having a first end and a second end, wherein the first end of the mounted socket is engageable with a light bulb, and the second end of the mounted socket is connected to the second end of the flexible member; and an electrical connection having a first end and a second end, wherein the first end of the electrical connection is connected to the second end of the contact base and the second end of the electrical connection is connected to the second end of the mounted socket wherein said contact base comprises screw threads and is interchangeable with bases having dimensions selected from a group consisting of mogul, admedium, medium and intermediate.

55. The adjustable light connection of claim 54 wherein the electrical connection is disposed within the flexible member.

56. The adjustable light connection of claim 54 wherein the contact base means is rated up to 660 Watts and up to 125 Volts.

57. The adjustable light connection of claim 54 wherein the contact base means is a socket-to-outlet adapter.

58. The adjustable light connection of claim 54 wherein the contact base means is operably connectable to only a single one of the light socket means.

59. A kit comprising: a contact base engageable with a light socket; a mounted socket capable of being disposed distally from the contact base and capable of fixedly accepting a light bulb; and an electrical connection having a first end connectable to the contact base and a second end connectable to the mounted socket, wherein the mounted socket, when the contact base is removably engaged with the light socket and the mounted socket in operable connection with, but distally disposed from, the mounted socket, is selectively positionable in a three dimensional placement space relative to the contact base and is capable of substantially retaining a position while supporting a weight of about 226 grams wherein said contact base comprises screw threads and is interchangeable with bases having dimensions selected from a group consisting of mogul, admedium, medium and intermediate.

60. The kit of claim 59, the kit further comprising a flexible member having a first end and a second end, the first end of the flexible member connectable to the contact base and the second end of the flexible member connectable to the mounted socket.

* * * * *